US007434802B2

(12) United States Patent
Yamamoto

(10) Patent No.: US 7,434,802 B2
(45) Date of Patent: Oct. 14, 2008

(54) SHEET DISCHARGING APPARATUS AND SHEET TREATING APPARATUS PROVIDED WITH THE SAME

(75) Inventor: Yuichi Yamamoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 714 days.

(21) Appl. No.: 11/059,387

(22) Filed: Feb. 17, 2005

(65) Prior Publication Data

US 2005/0206069 A1 Sep. 22, 2005

(30) Foreign Application Priority Data

Feb. 27, 2004 (JP) ..... 2004-055560

(51) Int. Cl.
*B65H 29/70* (2006.01)

(52) U.S. Cl. ..... 271/188

(58) Field of Classification Search ..... 271/209, 271/188

See application file for complete search history.

(56) References Cited

U.S. PATENT DOCUMENTS 4,777,498 A 10/1988 Kasamura et al. ..... 346/150
4,787,616 A 11/1988 Sasaki et al. ..... 271/3
4,799,084 A 1/1989 Koike et al. ..... 355/14 SH
5,194,904 A * 3/1993 Ruch ..... 399/397
6,131,898 A 10/2000 Hiroi et al. ..... 271/10.03
6,554,270 B2 4/2003 Yamamoto ..... 271/117
6,655,864 B2 * 12/2003 Saito ..... 400/642
7,200,356 B2 * 4/2007 Kawamoto ..... 399/405

FOREIGN PATENT DOCUMENTS

JP 2002-226114 8/2002

* cited by examiner

*Primary Examiner*—David H Bollinger
(74) *Attorney, Agent, or Firm*—Fitzpatrick, Cella, Harper & Scinto

(57) ABSTRACT

A sheet discharging apparatus has a sheet conveying path on which a sheet is conveyed, a discharge port for discharging therethrough the sheet conveyed on the sheet conveying path, a discharging tray on which the sheet discharged from the discharge port is stacked, and a rigidity heightening device provided on the discharge port for heightening a rigidity of the sheet discharged. The rigidity heightening device heightens a rigidity of the sheet at a beginning of discharge of the sheet from the discharge port, and weakens the rigidity of the sheet in a course of discharge of the sheet from the discharge port so that the sheet is discharged onto the discharging tray in such a state that the sheet hangs down.

12 Claims, 14 Drawing Sheets

SHEET DISCHARGING APPARATUS AND SHEET TREATING APPARATUS PROVIDED WITH THE SAME

BACKGROUND OF THE INVENTION

1. Field of the Invention

This invention relates to a sheet discharging apparatus and a sheet treating apparatus provided with the same.

2. Description of Related Art

Among image forming apparatuses such as a digital copying machine, a printer and a facsimile apparatus, there is one provided with an image forming portion and an image reading apparatus for reading an original, and adapted to form an image on the basis of image information read by this image reading apparatus.

The image reading apparatus provided in such a conventional image forming apparatus, or an image reading apparatus as a unit is provided with an automatic original feeder for continuously feeding originals which is an example of a sheet discharging apparatus. As such an automatic original feeder (automatic document feeder: ADF), there have been proposed various ones provided with the function of separating and feeding a plurality of originals placed on an original plate (platen) one by one and conveying them to an image reading portion, and further reversing and discharging the originals.

Now, an original image reading method in the image reading apparatus provided with such an automatic original feeder is divided broadly into a fixed reading method of placing an original on an original plate, and optically reading image information while moving image reading means, and a flow reading method of fixing image reading means at a predetermined location on an original plate, and optically reading image information while conveying an original.

In recent years, chiefly the flow reading method has been adopted from such advantages as an improvement in productivity such as the treating capacity within a predetermined time, and the downsizing of the apparatus. In the case of this flow reading method, a reversal path for copying with a both-side original can also be minimized.

In such a conventional ADF 180, however, particularly when the rigidity of an original P which is a sheet is small, in other words, when the stiffness of the original P is weak, there is a case where when it passes between a pair of discharging rollers 16 in a spaced-apart state, as shown in FIG. 9 of the accompanying drawings, the leading edge portion of the original leans on a discharging tray 19 and becomes rounded on the discharging tray 19, thus causing jam.

So, heretofore, as a countermeasure for this, as shown in FIG. 10 of the accompanying drawings, a rib 55 for heightening the rigidity of the original P has been provided on a sheet discharging lower guide 51*a* (see Japanese Patent Application Laid-Open No. 2002-226114). The jam of the original P caused by the original P becoming rounded on the discharging tray 19 is prevented by the rigidity of the original P being enhanced by the rib 55.

In such a conventional ADF 280 and an image reading apparatus provided with the same, however, when the rigidity of the original P is thus heightened by the rib 55, the jam of the original P can be prevented, but the trailing edge portion of the original P is also heightened in rigidity. Therefore, when the trailing edge of the original P is kicked out by the pair of discharging rollers 16 now in contact with each other and the sheet is discharged onto the discharging tray, the original P jumps excessively due to being heightened in rigidity, thus causing faulty alignment in a direction in which the sheet is discharged. Also, when it jumps excessively, the original P may sometimes fall from the discharging tray 19.

SUMMARY OF THE INVENTION

The present invention has been made in view of such circumstances, and has as its object to provide a sheet discharging apparatus which can more reliably prevent the occurrence of jam when a sheet is discharged onto a discharging tray and also, can enhance the aligning property of the sheet on the discharging tray in a discharging direction.

The sheet discharging apparatus of the present invention has:

- a sheet conveying path on which a sheet is conveyed;
- a discharge port for discharging therethrough the sheet conveyed on the sheet conveying path;
- a discharging tray on which the sheet discharged from the discharge port is stacked; and
- a rigidity heightening means provided on the discharge port for heightening a rigidity of the sheet discharged,
- wherein the rigidity heightening means heightens a rigidity of the sheet at a beginning of discharge of the sheet from the discharge port, and weakens the rigidity of the sheet in a course of discharge of the sheet from said discharge port so that the sheet is discharged onto the discharging tray in such a state that the sheet hangs down.

DETAILED DESCRIPTION OF THE PREFERRED EMBODIMENTS

The best aspect for carrying out the present invention will hereinafter be described in detail with reference to the drawings.

Figure 6:
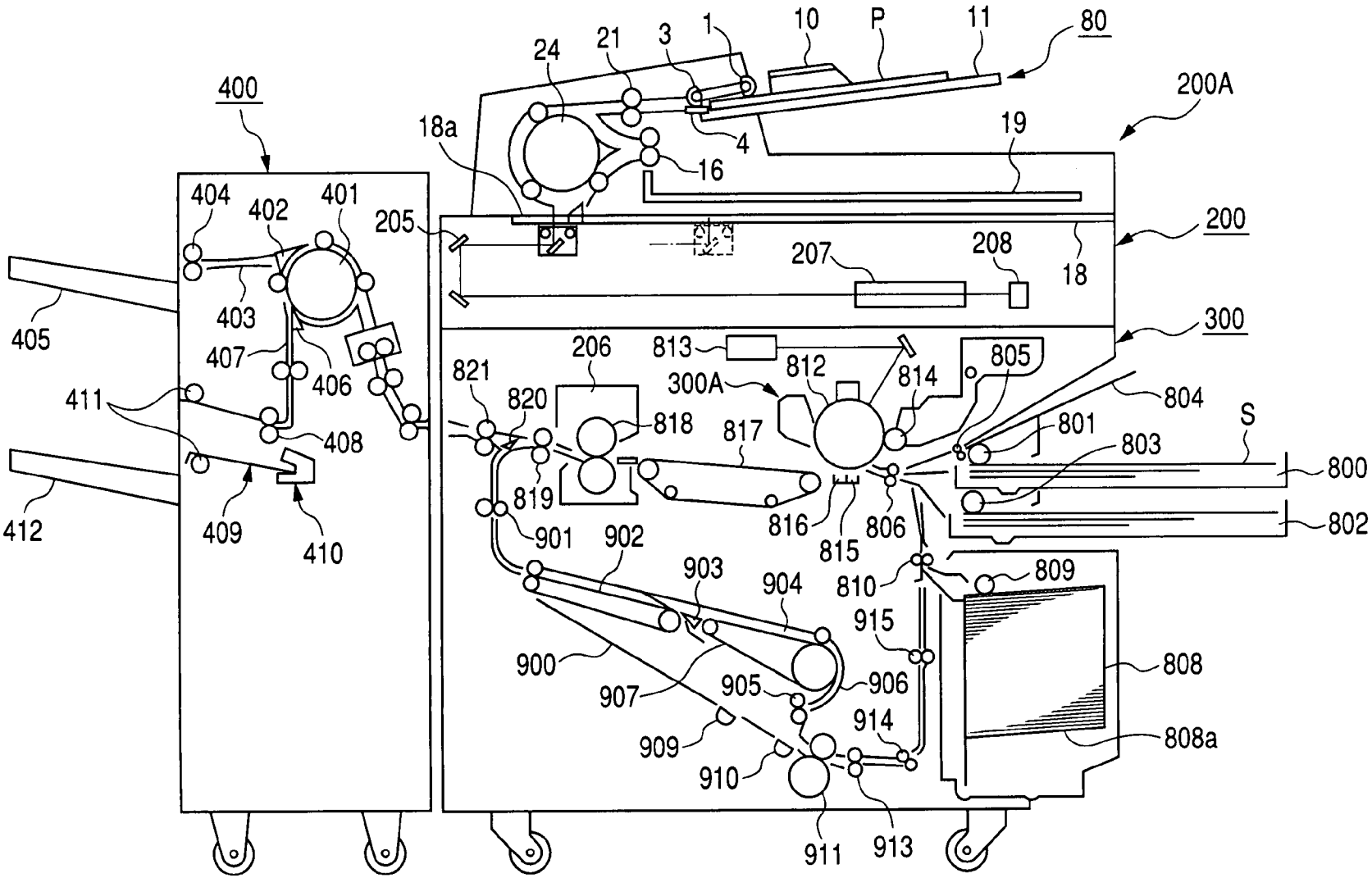
FIG. 6 shows the general construction of a copying machine provided with the sheet discharging apparatus according to the embodiment of the present invention.

Referring to FIG. 6 which shows the general construction of a copying machine which is an example of an image forming apparatus provided with an image reading apparatus, a copying machine main body 200A is comprised of an image inputting portion 200 and an image outputting portion 300. Also, an ADF which is an automatic original feeder of the image inputting portion 200, and a finisher 400 is provided sideways of the image outputting portion 300.

The image outputting portion 300 is provided with an upper cassette 800 and a lower cassette 802 containing therein sheets S which are recording mediums, a manually feeding guide 804 and a sheet deck 808. During image forming, the sheets S contained in the upper cassette 800 and the lower cassette 802 are separated and fed one by one by feed rollers 801 and 803, respectively, and a separating pawl (not shown), and are directed to registration rollers 806.

Also, sheets stacked on the manually feeding guide 804 are likewise directed one by one to the registration rollers 806 through a pair of feed rollers 805. The sheet deck 808 is provided with intermediate plate 808*a* movable up and down by a motor or the like therein, and sheets S stacked on the intermediate plate 808*a* are separated and fed one by one by a feed roller 809 and a separating pawl (not shown), and are directed to the registration rollers 806 through conveying rollers 810.

On the other hand, during image forming, a toner image is formed on a photosensitive drum 812 in accordance with the number of copies set for one original P read in the image inputting portion 200. The sheets S corresponding to the number of copies are fed out of one of the cassettes 800, 802, etc. each time an image is formed on the photosensitive drum 812, and thereafter are registered with the photosensitive drum 812 by the registration rollers 806 and are conveyed to an image forming portion 300A.

In the image forming portion 300A, an optical system 813, a developing device 814, a transfer charging device 815 and a separation charging device 816 are provided around the photosensitive drum 812, and design is made such that a laser beam is applied from the optical system 813 onto the uniformly charged surface of the photosensitive drum 812, whereby an electrostatic latent image is formed thereon, and a toner image is formed thereon by the developing device 814, and thereafter the toner image is transferred to the sheet S by the transfer charging device 815.

Thereafter, the sheet S attracted to the photosensitive drum 812 is stripped off by the separation charging device 816, and the sheet to which the toner image has been transferred is sent to a fixing apparatus 818 by a conveying belt 817, and heat and pressure are applied to the sheet, whereby the toner image thereon is fixed. The sheet passes through the fixing apparatus 818 is directed to a flapper 820 by conveying rollers 819, and is sent to an intermediate tray 900 or discharged to a sheet treating apparatus 400, by discharge rollers 821.

The intermediate tray 900 is for re-feeding the sheet, when images are to be formed on both sides of the sheet (both-side recording) or when images are to be superimposed and formed on one side of the sheet (multiplex recording), the intermediate tray is adapted to stack thereon the sheet on which an images has been once formed.

The intermediate tray 900 is provided with conveying rollers 901, a conveying belt 902, a flapper 903, a conveying belt 904 and conveying rollers 905, and design is made such that in the case of both-side recording, the sheet is directed to the intermediate tray 900 through a path 906, and in the case of multiplex recording, the sheet S is directed to the intermediate tray 900 through a path 907.

Further, the sheets thus placed on the intermediate tray 900 are separated and re-fed one by one from below by the action of auxiliary rollers 909, 910 and a pair of forwardly and reversely rotatable separating rollers 911. The re-fed sheet is directed to the image forming portion 300A through conveying rollers 913, 914, 915, conveying rollers 810 and the registration rollers 806, and an image is formed thereon. After image forming, the sheet is discharged in the same manner as previously described.

The sheet having an image formed thereon which has been discharged from the copying machine main body 200A is discharged to the finisher 400. Then, in the finisher 400, in the case of a non-sorting mode, the sheet is discharged onto and stacked on a sample tray 405 by rollers 404 through a buffer roller 401, a flapper 402 and a non-sorting mode path 403.

Also, in the case of a sorting mode, the sheet is discharged onto a treating tray 409 by discharge rollers 408 through the buffer roller 401, a flapper 406 and a sorting mode path 407, and is temporarily stacked thereon. Thereafter, a bundle of sheets on the treating tray 409 have their opposite end portions in a direction intersecting with a sheet conveying direction aligned by an aligning member (not shown), and as required, the trailing edge portions of the bundle of sheets are stapled by a stapler 410, and thereafter the bundle of sheets are discharged onto and stacked on a stack tray 412 by a pair of bundle discharge rollers 411. When the number of sheets is plural, gathering or collating in which the sheets are stacked in the direction intersecting with the sheet conveying direction deviated by the aligning member is effected on each bundle of sheets.

Now, an auto original feeder (Auto Document Feeder: ADF) 80 is designed to be openable and closable relative to the image inputting portion 200, and acts to press originals placed on an original plate 18. Also, in the ADF 80, such a pressing member (not shown) as presses the originals and the original plate 18 is provided so as to cover the entire surface of the original plate 18.

Figure 7:
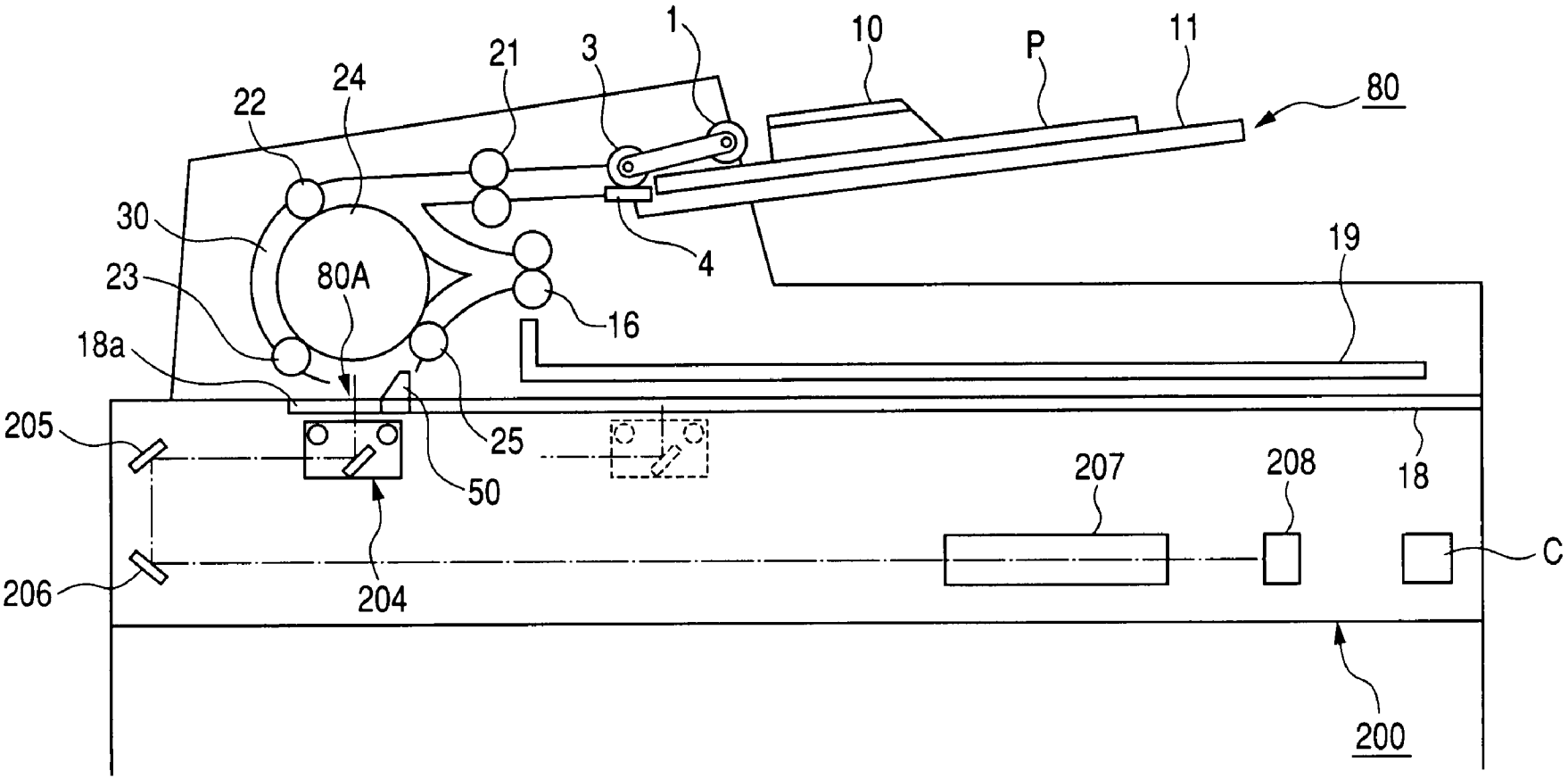
FIG. 7 illustrates the construction of an image reading apparatus provided with the sheet discharging apparatus according to the embodiment of the present invention.

When an originals image is to be read in the ADF 80, the originals P as sheets on a feeding tray 11 shown in FIG. 7 are first paid away in succession from the uppermost original P by a feed roller 1, and thereafter are separated one by one by separating portions 3 and 4, whereafter the original P has its skew feed corrected by registration rollers 21, and is U-turn-conveyed by a large-diametered roller 24 and rollers 23, 24 and 25.

An original plate (transparent glass) 18*a* serving also as a sheet guide is provided in a horizontal path on the lower side (between the rollers 23 and 25) of the large-diametered roller 24, and further a scanner unit 204 is at a halt (fixed) below the transparent glass 18*a*.

By the scanner unit 204 being thus at a halt, an image reading portion 80A reads the image of the original being conveyed by the ADF 80. That is, when the original image is to be read, light is applied to the original P passing the original plate 18*a* by the scanner unit 204 being at a halt (fixed) below the original plate 18*a*, and the reflected light thereof is inputted to an image sensor 208 through the intermediary of mirrors 205 and 206 and a lens 207, whereby the image information of the original P is read. The large-diametered roller 24 is designed to have a large diameter in order to eliminate the speed difference between rollers 22 and 23 around the reading portion.

On the other hand, the original P of which the image has been read is again directed into the ADF 80 by a scooping member 50 disposed between the original plate 18*a* and another original plate 18, and thereafter is directed to a pair of discharge rollers 16.

In the case of a one-side reading mode for reading one side of the original, the original is discharged onto a discharging tray 19 which is a sheet stacking portion by the pair of discharge rollers 16.

On the other hand, in the case of a both-side reading mode for reading the both sides of the original, the original is switch-back-conveyed by the reversal of the pair of discharge rollers 16 and the changeover of a flapper (not shown), and is fed to a skew feed correcting portion comprising the roller 22 and the large-diametered roller 24. Then, the skew feed of the original is corrected in this skew feed correcting portion, whereafter the original again passes on the original plate 18*a* and at this time, the image on the back of the original P is read, whereafter the original is discharged onto the discharging tray 19 by the pair of discharge rollers 16.

In the ADF 80, in order to achieve downsizing, the diameter of the large-diametered roller 24 is made small and the path for reversal is formed short. If the path for reversal is short (that is, if a reversing portion constituted by the large-diametered roller 24 and the rollers 22, 23 and 25 is small), when a flapper 54 is changed over to thereby reverse the original P in order to read the both sides of a long original of A3 size or the like, the originals P pass by each other at the place of the pair of discharge rollers 16 while the leading edge Pf of one original and the trailing edge Pb of the one original frictionally contact with each other.

Also, a preceding original conveyed by the large-diametered roller 24 and the roller 22 after switched back by the pair of discharge rollers 16 and a succeeding original conveyed toward the discharging tray 19 by the large-diametered roller 24 and the roller 25 are conveyed so as to pass by each other at a location whereat the pair of discharge rollers 16 are provided.

When the leading edge and the trailing edge frictionally contacts with each other due to the originals P passing by each other, the originals P cannot be smoothly reversed and conveyed by a load caused by the frictional contact. Consequently, when the originals P pass by each other, of a drive roller 16*a* and a driven roller 16*b* which constitute the pair of discharge rollers 16, the driven roller 16*b* is spaced apart from the drive roller 16*a* by a solenoid S which is driving means. By the pair of discharge rollers 16 being spaced apart from each other, the frictional contact between the leading edge and trailing edge of the originals P is alleviated and also, the leading edge of the original becomes prevented from contacting with the pair of discharge rollers 16. Likewise, the pair of discharge rollers are also spaced apart from each other when the preceding original and the succeeding original pass by each other.

When the pair of discharge rollers 16 are thus spaced apart from each other, the leading edge portion Pf of the original P is conveyed toward the discharging tray 19 by at least the large-diametered roller 24 and the roller 22. Also, before the trailing edge portion Pb of the original P passes through the nip between the pair of upstream side rollers 24 and 25 nearest to the pair of discharge rollers 16, the pair of discharge rollers 16 are restored from their spaced-apart state to their contacting state. The original is nipped by the pair of discharge rollers 16 brought into contact with each other and is discharged to the discharging tray 19.

The construction of the vicinity of the sheet discharging portion of the ADF 80 will now be described in detail.

Figure 1:
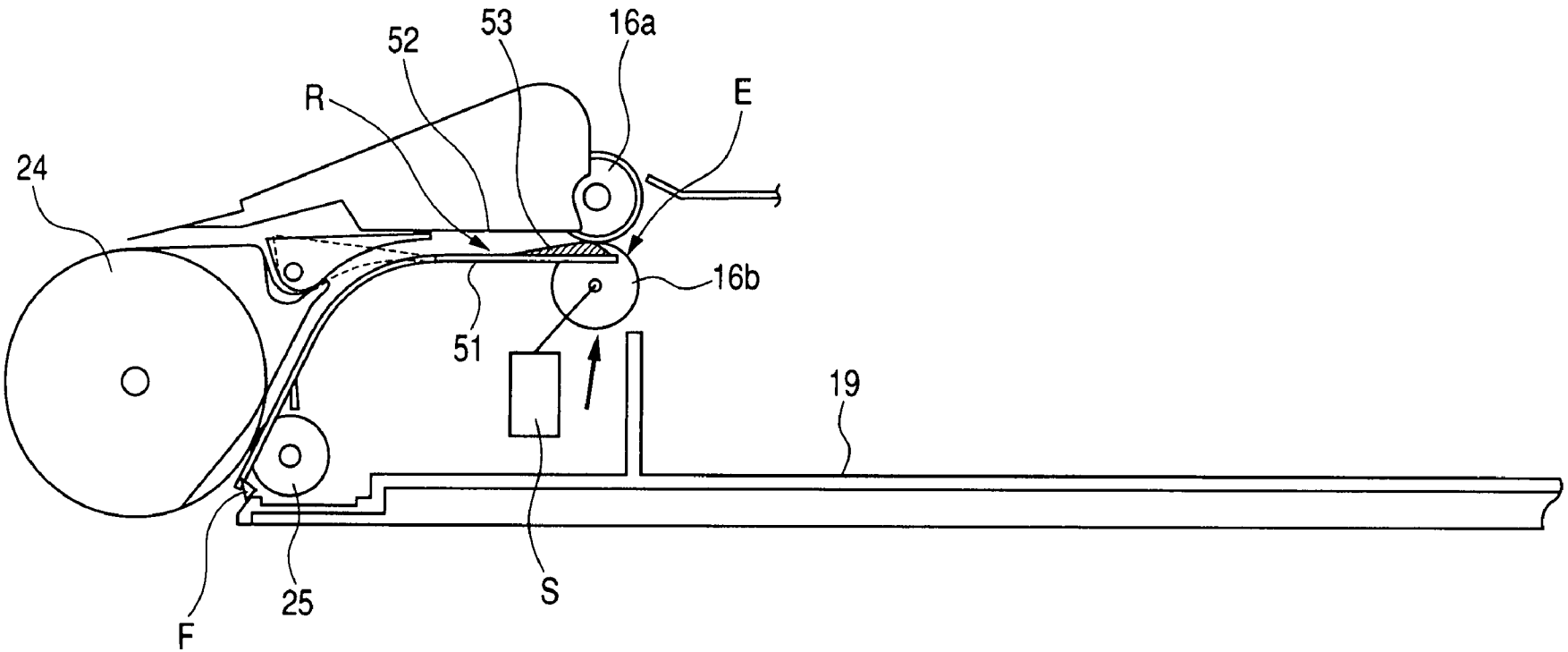
FIG. 1 shows the construction of the vicinity of a discharging portion in an ADF provided in an image reading apparatus which is an example of a sheet discharging apparatus according to an embodiment of the present invention.

FIG. 1 shows the construction of the vicinity of the sheet discharging portion of the ADF 80 provided in an image reading apparatus which is an example of a sheet discharging apparatus according to an embodiment of the present invention.

In FIG. 1, the reference numerals 51 and 52 designate a discharging lower guide and a discharging upper guide, respectively, provided upstream of the pair of discharge rollers 16 with respect to a sheet discharging direction. A sheet conveying path R for guiding the original conveyed by the large-diametered roller 24 (conveying roller) constituting conveying means and the driven roller 25 toward the pair of discharge rollers 16 which are a pair of rollers movable toward and away from each other is formed by the discharging lower guide 51 and the discharging upper guide 52. A discharge port E through which the sheet passes when it is discharged out of the apparatus is provided at the end portion of the sheet conveying path R.

On that portion of the discharging lower guide 51 which is a guide member constituting the bottom surface of the sheet conveying path R which is near the pair of discharge rollers 16, a projected member 53 (rib) for abutting against the original and upwardly flexing it to thereby enhance the rigidity of the original being discharged is provided so as to protrude upwardly. That is, the projected member 53 is a rigidity enhancing member for enhancing the rigidity of the sheet being discharged from the discharge port E.

Figure 2:
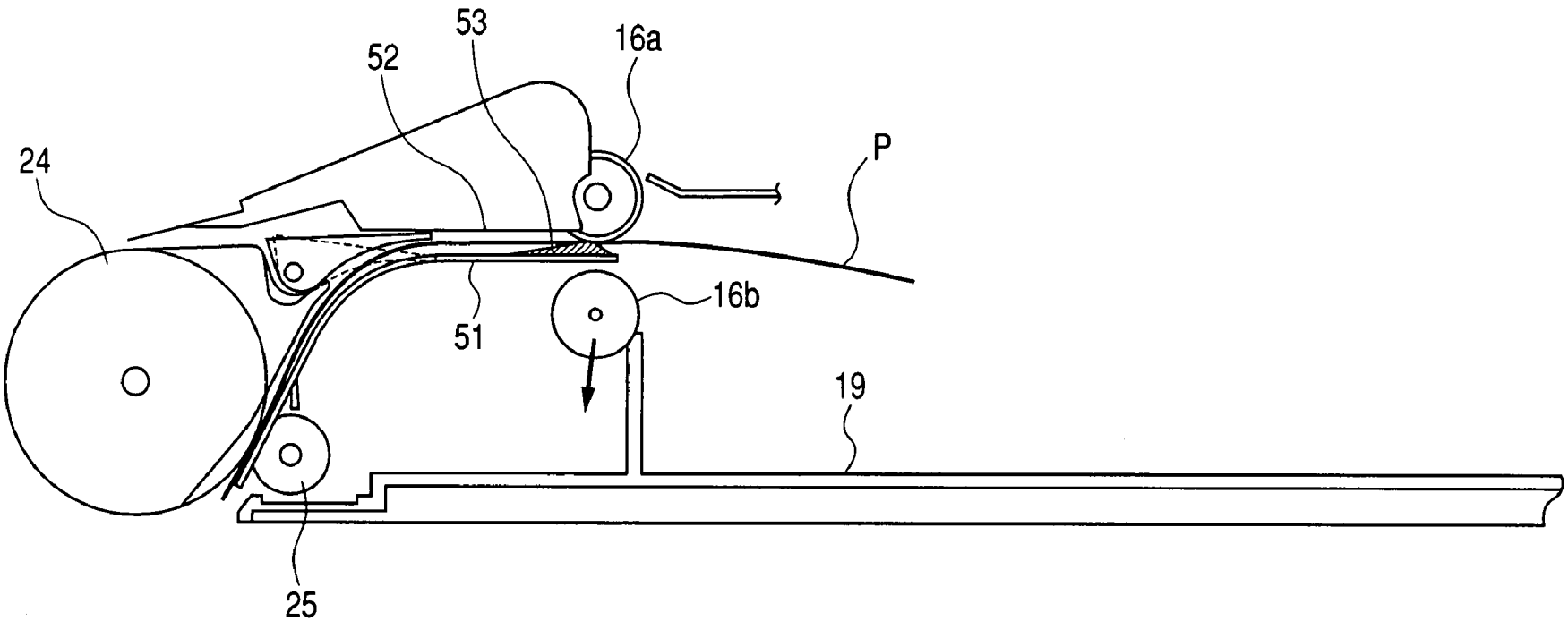
FIG. 2 shows the state when a pair of discharge rollers provided in the ADF are spaced apart from each other.
Figure 8:
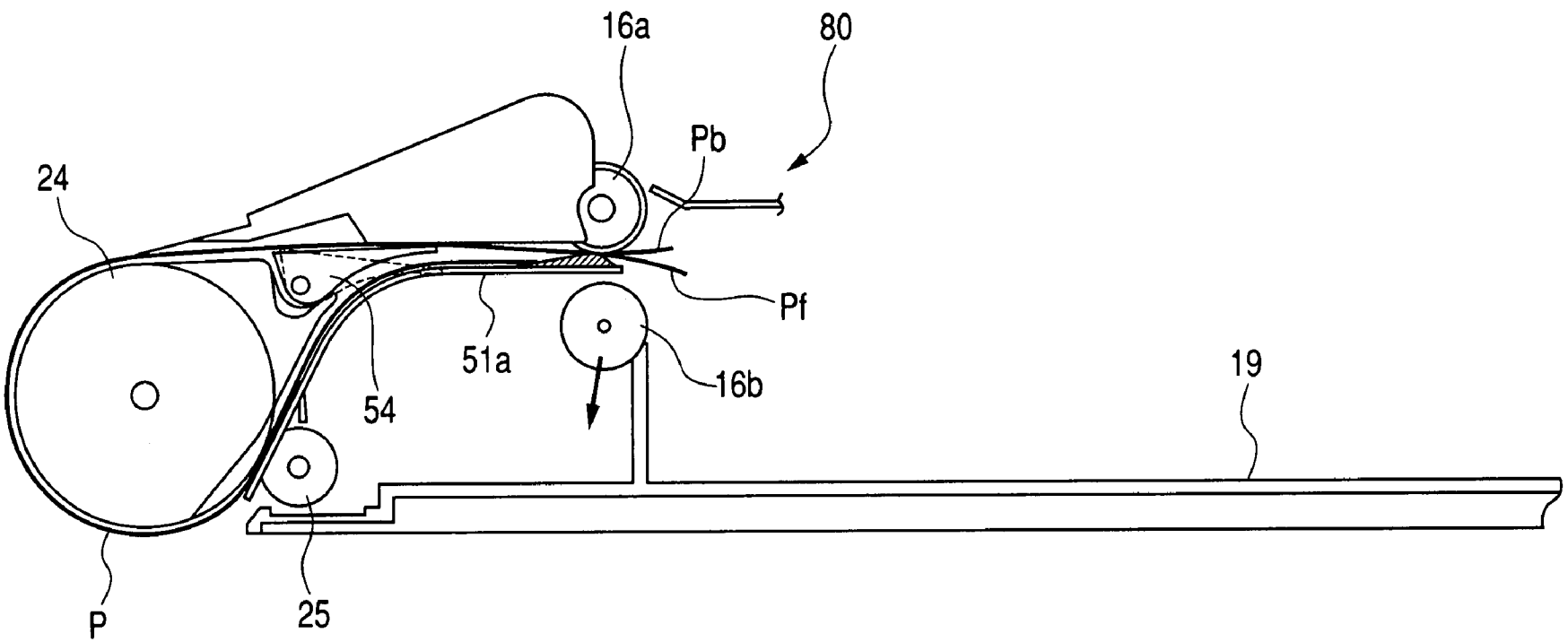
FIG. 8 shows the construction of the vicinity of a discharging portion in an ADF provided in the image reading apparatus provided with the sheet discharging apparatus according to the embodiment of the present invention.

The driven roller 16*b* which is one of the pair of discharge rollers 16 is designed to be movable toward and away from the drive roller 16*a* by the solenoid S which is the driving means in order to cope with the passing by (see FIG. 8) of the originals at the pair of discharge rollers 16 occurring when an original of a large size such as A3 is reversed to thereby read the image of the back side thereof. When the leading edge portion of the original comes into between the pair of discharge rollers 16, the solenoid S is controlled by a controller C so that the pair of discharge rollers 16 are brought into such a spaced-apart state as shown in FIG. 2.

In the present embodiment, the height of the projected member 53 is set to such a height that when the driven roller 16*b* constituting the pair of discharge rollers 16 is moved to the discharging lower guide 51 side and the pair of discharge rollers 16 becomes spaced apart from each other, the original P passes while contacting with and being flexed by the projected member 53, and when the pair of discharge rollers 16 are in contact with each other, the original P passes without being flexed.

Specifically, design is made such that the height position of the vertex of the projected member 53 is between the height position of the point of contact between the pair of discharge rollers 16, i.e., the nip between the drive roller 16*a* and the driven roller 16*b*, and the bottom surface of the discharging lower guide 51 and also, the vertex of the projected member 53 protrudes upwardly of the upper end of the driven roller 16*b*. Here, "upwardly of the upper end of the driven roller 16*b*" refers to being upward of a horizontal plane passing the upper end of the driven roller 16*b*.

Figure 3:
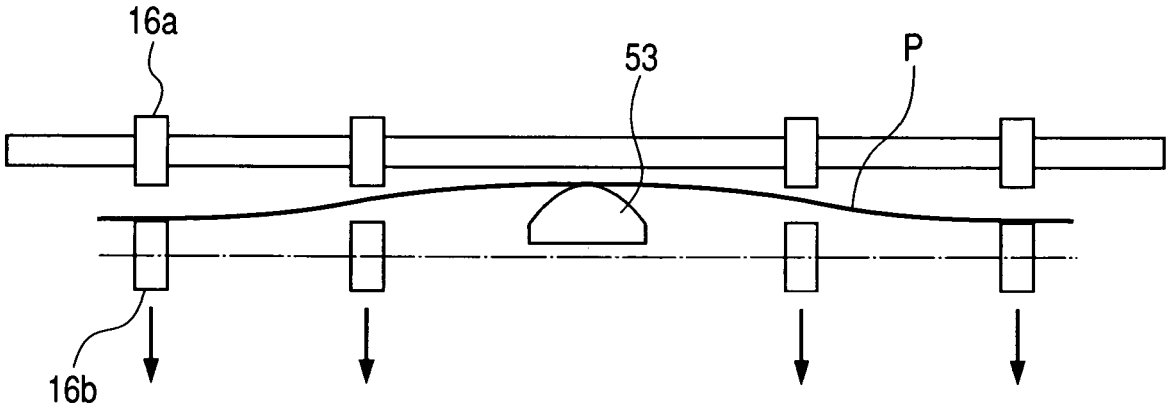
FIG. 3 shows a state in which an original is flexed by a projected member when the pair of discharge rollers are spaced apart from each other.

By the height of the projected member 53 being set as described above, when the pair of discharge rollers 16 are spaced apart from each other, the driven roller 16*b* is located below the projected member 53. Consequently, as shown in the side view of FIG. 3, the central portion of the original P contacts with the projected member 53 and the original P flexes so as to be curved in a cross section perpendicular to the discharging direction of the original. In the present embodiment, the original is conveyed while flexing so that the opposite end portions of the original may be downward.

Figure 9:
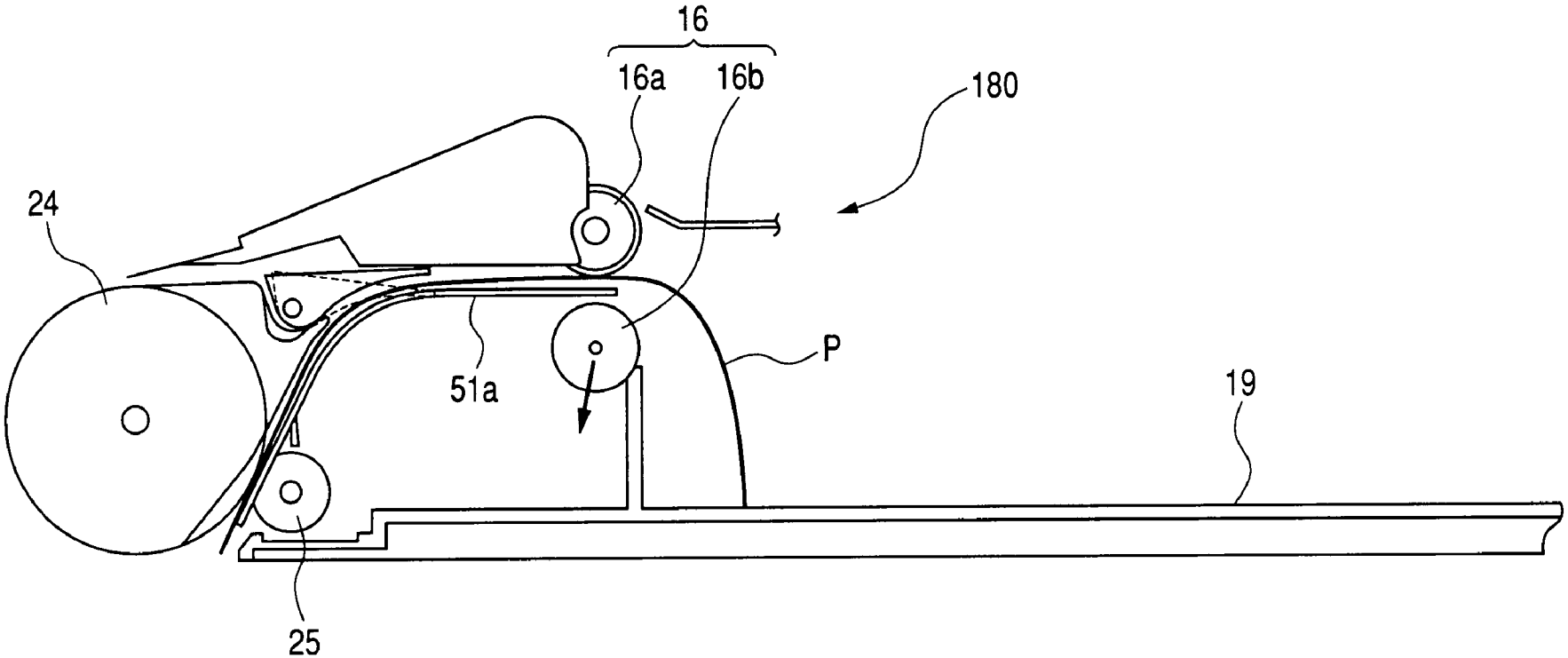
FIG. 9 shows the state when discharge rollers provided in a conventional ADF are spaced apart from each other.

The opposite end portions of the original P are flexed downwardly, whereby the rigidity of the original P in a direction perpendicular to the plane of the sheet is heightened. By the rigidity of the original being heightened, the original P is conveyed without the leading edge portion thereof leaning on the discharging tray 19 in the course of discharge of the original, as shown in FIG. 2. As descried above, the rigidity of the original P being conveyed is heightened by the projected member 53, whereby the occurrence of the jam due to such rounding caused by the leading edge portion leaning on the discharging tray 19 as shown in FIG. 9 already described can be prevented. The course of discharge of the original referred to here means that the original is being conveyed with the leading edge thereof protruded from the discharge port E to the outside of the apparatus.

While in the present embodiment, a single projected member 53 is provided on the substantially central portion in a direction orthogonal to the conveying direction, a plurality of projected members 53 may be provided in the axial direction of the pair of discharge rollers 16. When a plurality of projected members 53 are provided, the original comes to wave in the widthwise direction thereof, and is conveyed with its rigidity more heightened.

Figure 4:
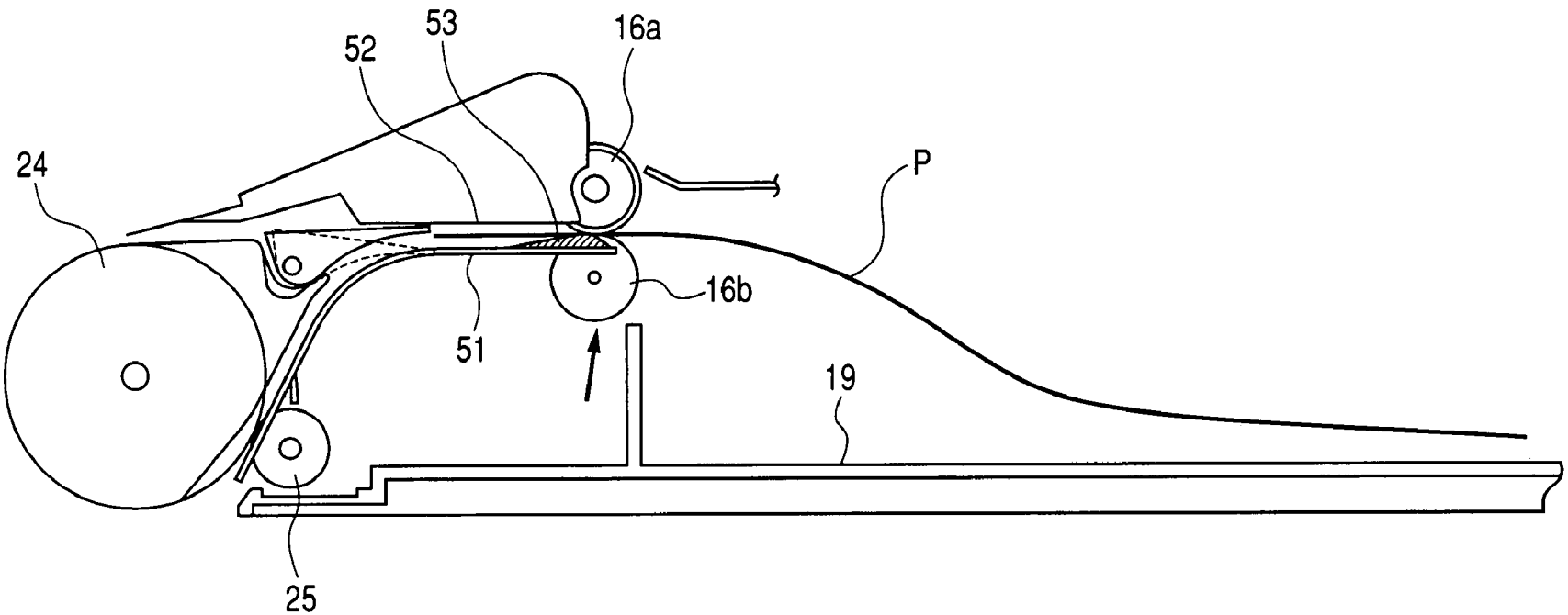
FIG. 4 shows the state when the pair of discharge rollers are in contact with each other.

On the other hand, when the original P is thus being discharged (conveyed) (the sheet is being discharged) toward the discharging tray 19 and before the trailing edge portion of the original passes the position of contact between the large-diametered roller 24 and the driven roller 25, the driven roller 16*b* is moved up and as shown in FIG. 4, the pair of discharge rollers 16 come into contact with each other. The timing at which the driven roller 16*b* is moved up is based on a signal from a sensor F for detecting that the original has passed a predetermined position. That is, when the sensor F detects the passage of the trailing edge of the original, a controller C controls the solenoid S on the basis of the result of the detection to thereby move up the driven roller 16*b* and bring it into contact with the drive roller 16*a*.

Figure 5:
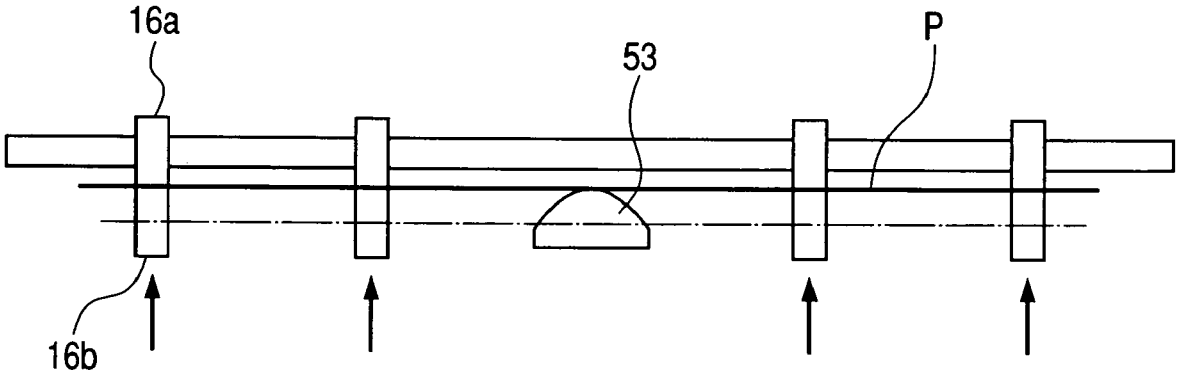
FIG. 5 shows a state in which the original is conveyed without being downwardly flexed when the pair of discharge rollers are in contact with each other.

As already described, the height of the vertex of the projected member 53 is set to such a height that when the pair of discharge rollers 16 are in contact with each other, the original P passes without flexing. In other words, design is made such that when the pair of discharge rollers 16 are brought into contact with each other, the rigidity of the original so far heightened by the projected member 53 weakens. In the present embodiment, as shown in FIG. 5, the height position of the vertex of the projected member 53 is set so as to be the same as the height position of the point of contact between the pair of discharge rollers 16 and therefore, when the pair of discharge rollers 16 have been brought into contact with each other, the original P passes without being flexed.

After the pair of discharge rollers 16 have been brought into contact with each other, the original is nipped by the pair of discharge rollers 16 and is conveyed by the rotation of the pair of discharge rollers 16, and is discharged onto the discharging tray 19 by the pair of discharge rollers 16 with the rigidity of the original by the projected member 53 weakened.

While here has been shown by way of example a construction in which the height position of the vertex of the projected member 53 is the same position as the point of contact between the pair of discharge rollers 16, the vertex of the projected member 53 can be located at a position whereat the original is not flexed by the projected member when the pair of discharge rollers 16 have been brought into contact with each other and therefore, the height position of the vertex of the projected member 53 may be set so as to be located below the tangent (nip line) at the point of contact between the pair of discharge rollers 16. Also, the vertex of the projected member 53 may be located slightly above the nip line between the pair of discharge rollers 16 if the rigidity of the original weakens to such a degree that the leading edge side of the sheet hangs down toward the discharging tray 19.

Figure 10:
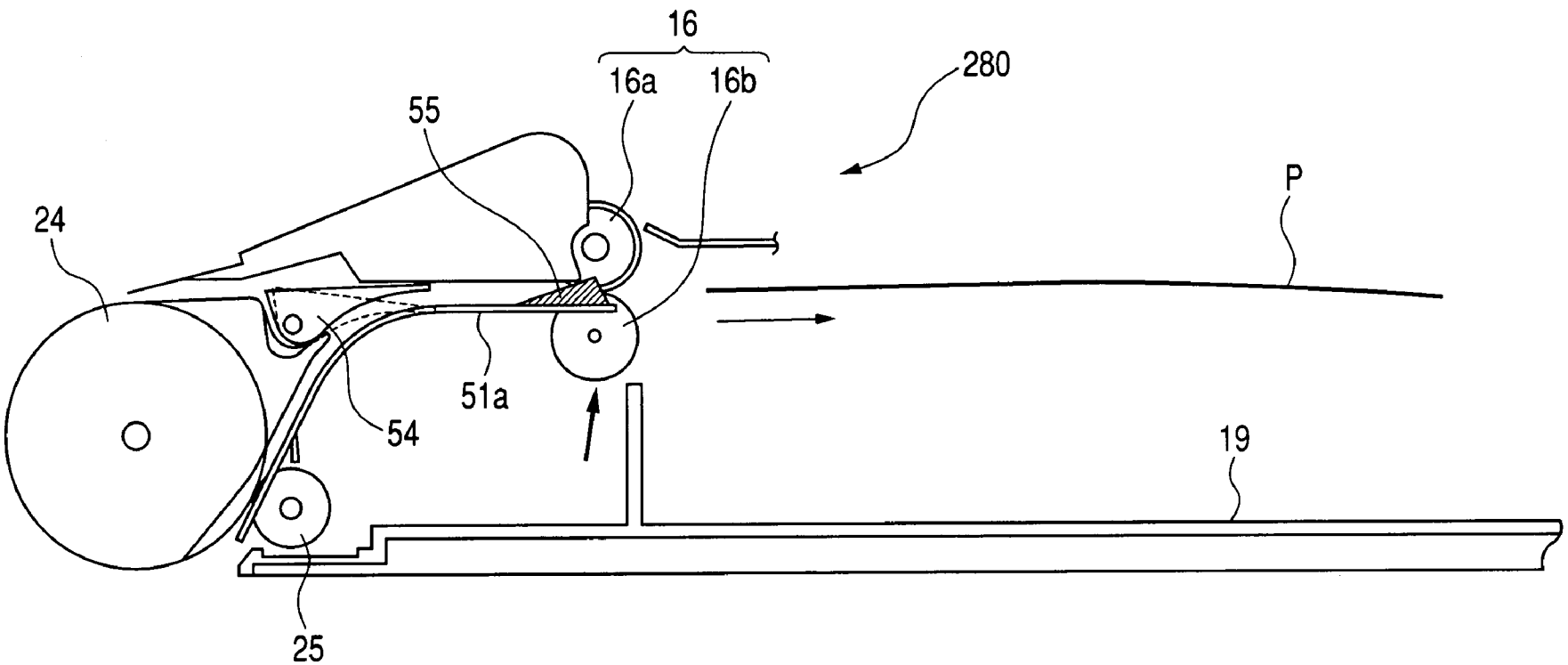
FIG. 10 shows the state when the discharge rollers are in contact with each other in the conventional ADF.

The original P is discharged by the pair of discharge rollers 16 without being flexed by the projected member 53, that is, with the rigidity of the original weakened, and therefore, when the original P is discharged onto the discharging tray 19 with the trailing edge of the original P kicked out by the pair of discharge rollers 16 brought into contact with each other, such excessive jump (faulty alignment) in the sheet discharging direction during the discharge of the original as shown in FIG. 10 and the fall of the original from the discharging tray 19 due to the excessive jump can be prevented.

In the above-described embodiment, the projected member 53 is provided on the discharging lower guide 51 and the height of this projected member 53 is set to such a height that when the pair of discharge rollers 16 have become spaced apart from each other, the original passes while contacting with and being flexed by the projected member 53, and when the pair of discharge rollers 16 are in contact with each other, the original passes without being flexed. Consequently, the original can be discharged (conveyed) so that the leading edge side of the original may pass through the discharge port E with the pair of discharge rollers 16 spaced apart from each other and the rigidity of the original heightened, and the occurrence of jam can be prevented. Also, with the pair of discharge rollers 16 brought into contact with each other in the course of discharge of the original from the discharge port E and the rigidity of the original weakened so that the original may hang down, the original is discharged from the pair of discharge rollers 16 onto the discharging tray 19, whereby the excessive jump (faulty alignment in the original discharging direction) of the original during the discharge of the original and the fall of the original from the discharging tray 19 can be prevented, and the original can be reliably discharged onto the discharging tray 19.

While description has hitherto been made of a construction designed to heighten rigidity for originals weak in stiffness, there are originals originally strong in stiffness, and such originals need not be heightened in rigidity and therefore, when an original strong in stiffness is to be discharged, a stiffness giving projected member 53 may be provided on the discharging lower guide 51 while being biased toward the original side by a spring which is biasing means (not shown).

As described above, the projected member 53 is provided while being biased toward the original side, whereby in a case where the original strong in stiffness is to be conveyed (discharged), when the pair of discharge rollers 16 become spaced apart from each other, the projected member 53 is pressed by the original and comes to be retracted toward the discharging lower guide 51 side against the biasing force of the spring. Thus, it becomes unnecessary to heighten rigidity for the original strong in stiffness, and the original can be conveyed (discharged) without a load by the projected member 53 being given to the original.

While in the description hitherto made, the ADF provided in the image reading apparatus has been shown as an example of the sheet discharging apparatus, the present invention is not restricted thereto, but can also be applied to an apparatus in an image forming apparatus provided with an image forming portion for forming an image on a sheet which discharges the sheet having an image formed thereon by the image forming portion from an image forming apparatus main body. Also, in the finisher 400 which effects gathering or collating or stapling or the like on the sheets, the present invention can be applied to an apparatus for discharging the sheets, for example, onto a sample tray 405, a treating tray 409 or a stack tray 412. That is, the present invention can cope with an apparatus having the function of discharging the sheets onto a discharging tray as a sheet stacking portion.

In the above-described embodiment, there has been shown by way of example a construction in which of the pair of discharge rollers 16, the driven roller 16*b* is moved to thereby change the relative position of the projected member 53 and the nip line between the pair of discharge rollers 16, and change over a state in which the rigidity of the sheet is heightened and a state in which the rigidity of the sheet is weakened. However, for example, an aspect that will be described below may be adapted as another aspect for weakening the rigidity of the sheet so that the sheet may hang down in the course of discharge, and discharge the sheet onto the discharging tray with its rigidity weakened.

Figure 11:
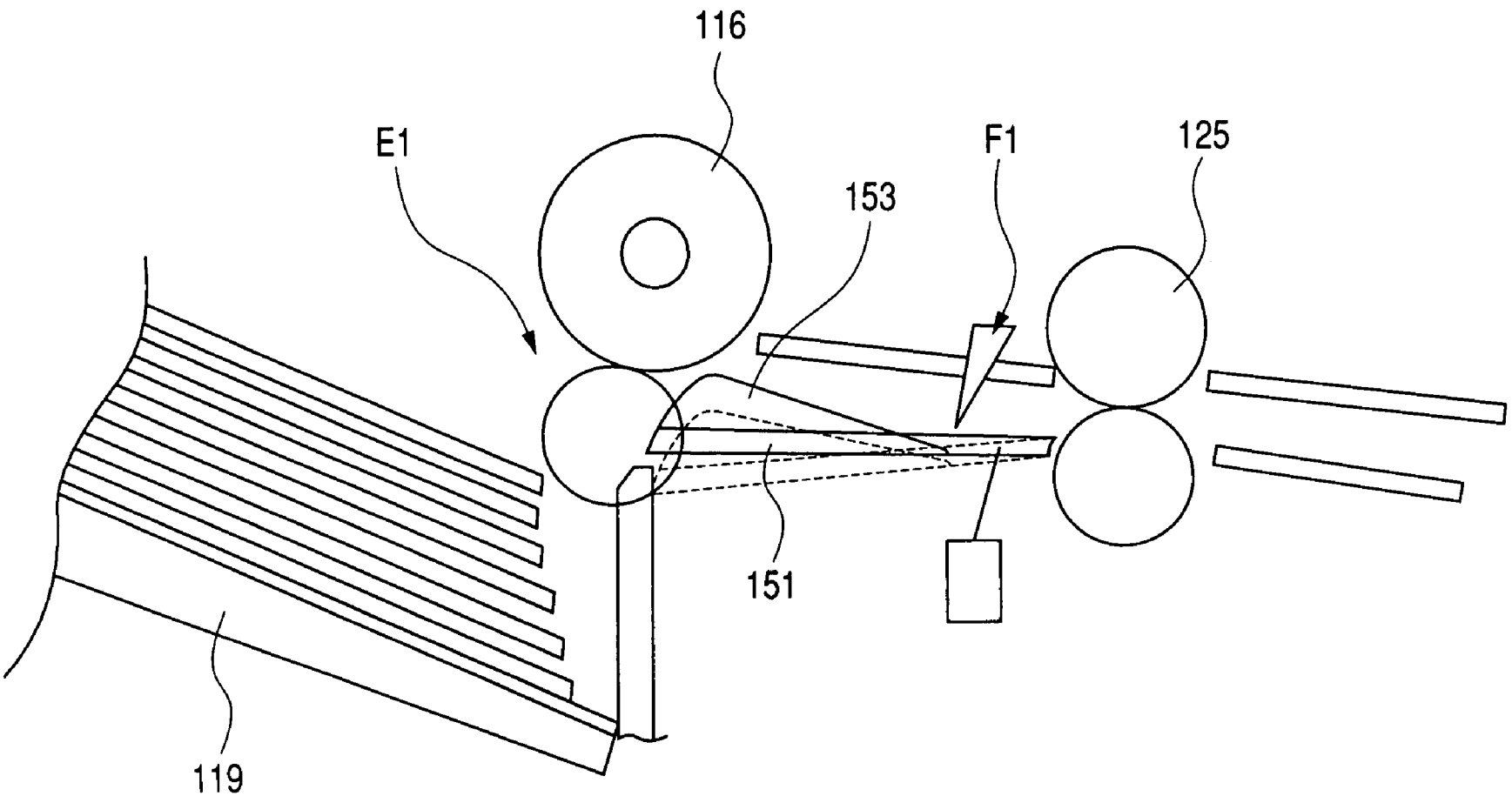
FIG. 11 is a cross-sectional view illustrating another aspect of the sheet discharging apparatus of the present invention.
Figure 12:
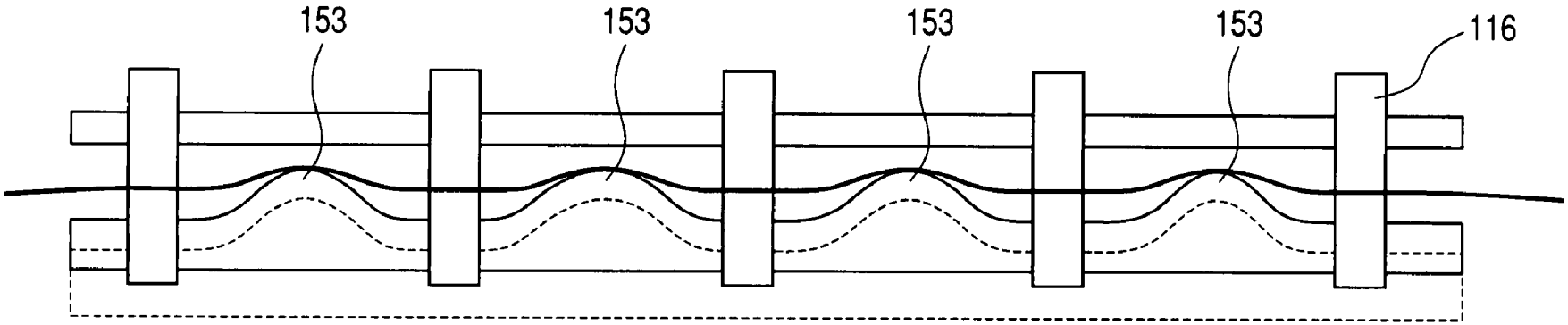
FIG. 12 is a side view illustrating another aspect of the sheet discharging apparatus of the present invention.
Figure 13:
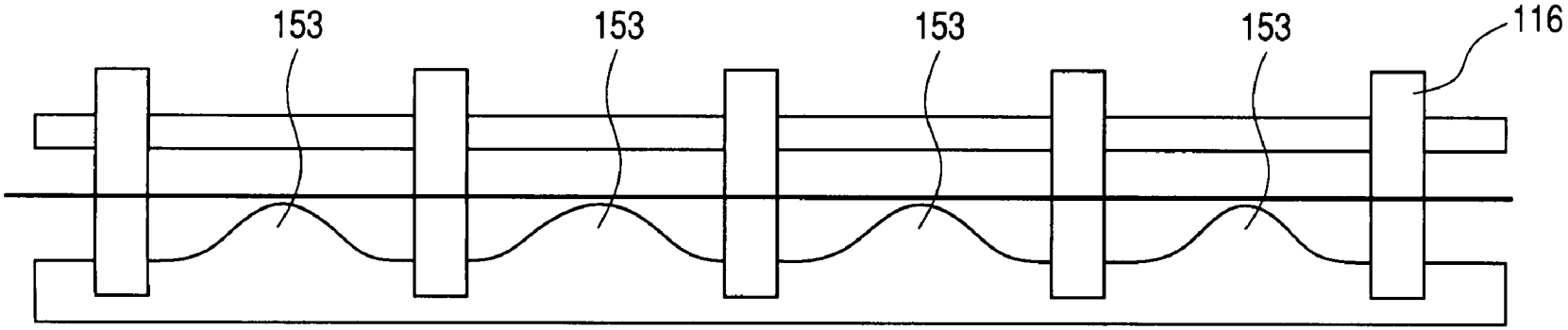
FIG. 13 is a side view illustrating another aspect of the sheet discharging apparatus of the present invention.

In a sheet discharging apparatus shown in FIGS. 11 to 13, a projected member (rib) 153 is provided on a lower guide 151 constituting a sheet conveying path. The lower guide 151 is held for movement to the position of solid line and the position of broken line indicated in FIG. 11 and FIG. 12 which is a side view. In FIG. 11, the sheet conveyed by a pair of conveying rollers 125 is discharged onto a discharging tray 119 by a pair of discharge rollers 116. Design is made such that the lower guide 151 is rocked to thereby change over a state in which the projected member 153 heightens the rigidity of the sheet and a state in which the rigidity of the sheet is weakened so that the sheet may hang down.

As shown in FIG. 12, the sheet is discharged (conveyed) from a discharge port E1 by the pair of discharge rollers 116 in a state in which it is flexed by the projected member 153 and the rigidity of the sheet has been heightened. The vertices of the projected member 153 in the state of FIG. 12 are located above the nip line between the pair of discharge rollers 116.

When in the course of discharge of the sheet by the pair of discharge rollers 116, the trailing edge of the sheet is detected by the sheet sensor F1, the projected member 153 integral with the lower guide 151 is downwardly moved by a solenoid S1. By the projected member 153 being downwardly moved, the flexure of the sheet by the projected member 153 becomes null and the rigidity of the sheet is weakened (see FIG. 13). With the rigidity of the sheet weakened, the sheet is discharged onto the discharging tray 119 by the pair of discharge rollers 116. The vertices of the projected member 153 in the state of FIG. 13 are located below the nip line between the pair of discharge rollers 116. However, the height position of the vertices of the projected member 153, even if it is somewhat above the nip line between the pair of discharge rollers 116, can be such a position that the rigidity of the sheet weakens so that the sheet may substantially hang down toward the discharging tray 119 side.

Figure 14:
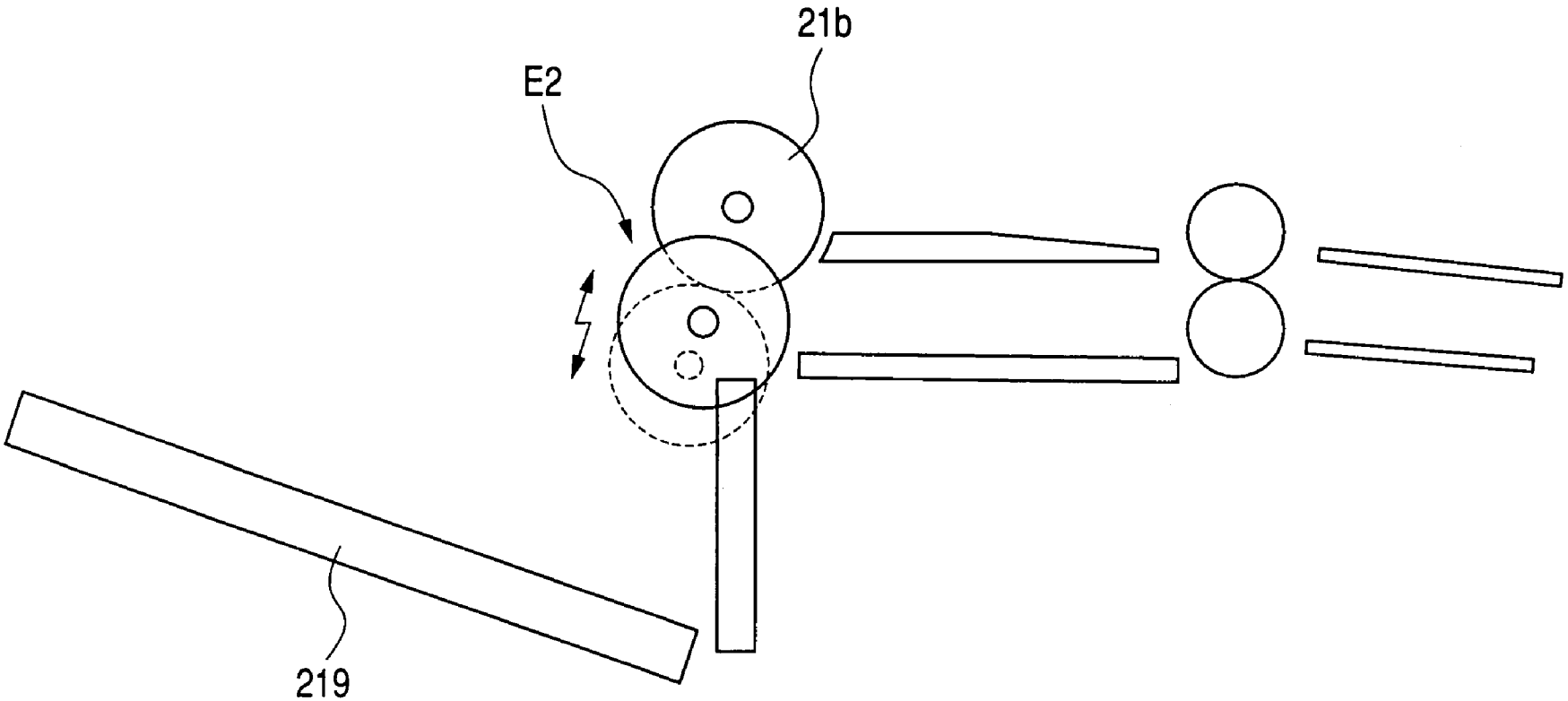
FIG. 14 is a cross-sectional view illustrating another aspect of the sheet discharging apparatus of the present invention.
Figure 15:
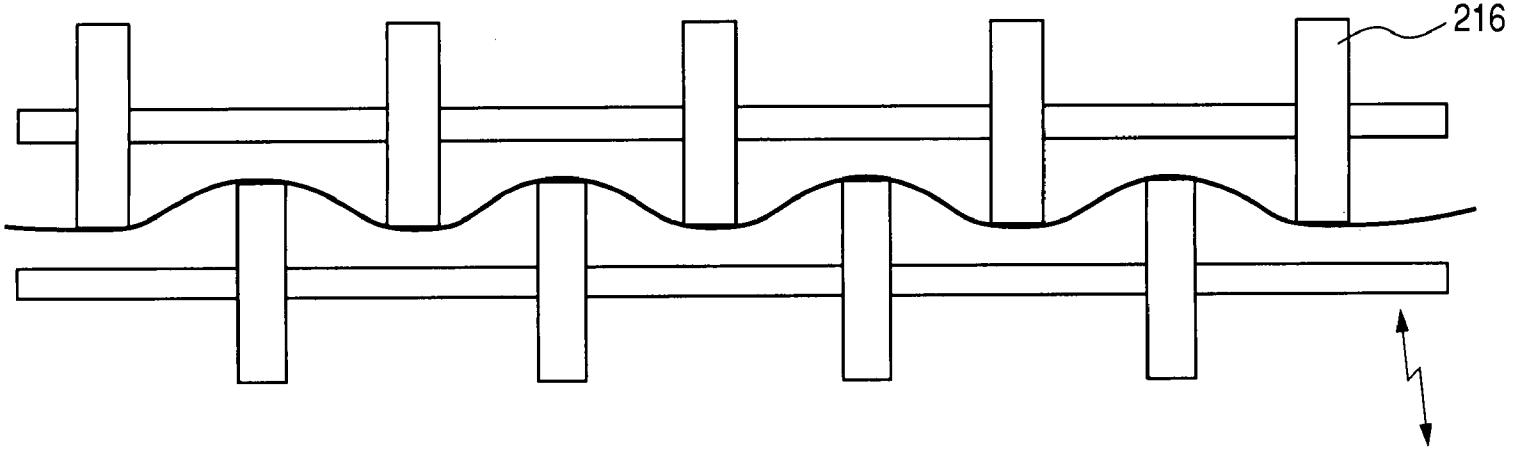
FIG. 15 is a side view illustrating another aspect of the sheet discharging apparatus of the present invention.
Figure 16:
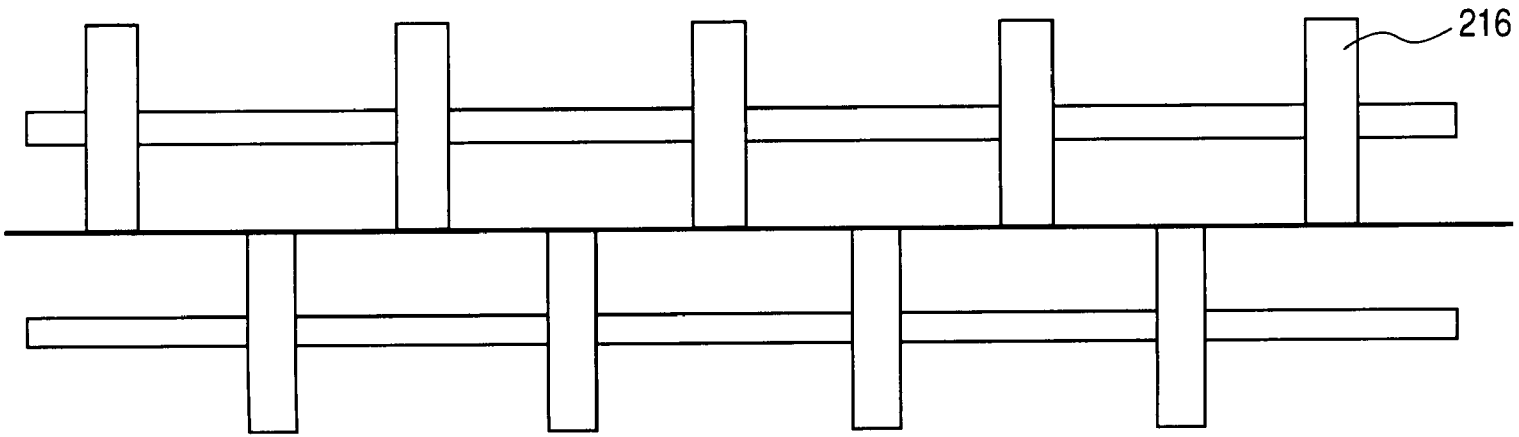
FIG. 16 is a side view illustrating another aspect of the sheet discharging apparatus of the present invention.

Also, as shown in the front cross-sectional view of FIG. 14 and the side views of FIGS. 15 and 16, there may be adopted an aspect in which the pair of discharge rollers for discharging the sheet onto the discharging tray are comb-toothed to thereby heighten the rigidity of the sheet being discharged. In this aspect, the pair of comb-toothed discharge rollers 216 perform the function as a member for discharging the sheet onto a discharging tray 219 and the function as a means for heightening the rigidity of the sheet.

Of the pair of comb-toothed discharge rollers 216, the lower discharge roller is moved, in the course of discharge of the sheet by the pair of comb-toothed discharge rollers 216, from a position as shown in FIG. 15 in which the sheet is flexed to thereby heighten the rigidity of the sheet (a position indicated by solid line in FIG. 14) to a position as shown in FIG. 16 in which the rigidity of the sheet is weakened (a position indicated by broken line in FIG. 14). With the rigidity of the sheet weakened, the pair of comb-toothed discharge rollers 216 discharge the sheet onto the discharging tray 219. The widening of the distance between the pair of comb-toothed discharge rollers 216 in order to weaken the rigidity of the sheet is effected by a controller through a driving portion for moving the rollers, on the basis of the output of a sheet sensor in the sheet conveying path. It holds true in any one of the above-described aspects to control by the controller on the basis of the output of the sheet sensor so as to change over a state in which the rigidity of the sheet is heightened and a state in which the rigidity of the sheet is weakened.

Any one of the above-described embodiments can be applied as an apparatus for discharging a sheet subjected to predetermined sheet treatment by a sheet treating portion in a sheet treating apparatus provided with the sheet treating portion for carrying out the process of reading the image of a sheet, the process of forming an image on a sheet, or the process of effecting stapling or gathering or collating on a bundle of sheets, etc.

In any one of the above-described embodiments, the rigidity of the sheet can be heightened during the discharge of the sheet to thereby prevent the occurrence of jam and also, when the sheet is to be discharged, the rigidity of the sheet is weakened and therefore, the excessive jump (faulty alignment) of the sheet and the fall of the sheet from the discharging tray when the sheet is discharged can be prevented and the sheet can be reliably discharged onto the discharging tray.

This application claims priority from Japanese Patent Application No. 2004-055560 filed Feb. 27, 2004, which is hereby incorporated by reference herein.

What is claimed is:

1. A sheet discharging apparatus comprising:

a sheet conveying path on which a sheet is conveyed;

a discharge port for discharging therethrough the sheet conveyed on said sheet conveying path;

a discharging tray on which the sheet discharged from said discharge port is stacked;

rigidity heightening means provided on said discharge port for heightening a rigidity of the sheet discharged, and a controller for controlling an operation of said rigidity heightening means, wherein said controller controls said rigidity heightening means to heighten a rigidity of the sheet at a beginning of discharge of the sheet from said discharge port, and to weaken the rigidity of the sheet in a course of discharge of the sheet from said discharge port.

2. A sheet discharging apparatus according to claim 1, wherein said rigidity heightening means has a projected member protruding in a direction substantially perpendicular to a plane of the sheet discharged from said discharge port, and said projected member deforms the sheet so as to be curved in a cross section perpendicular to a sheet discharging direction to thereby heighten the rigidity of the sheet.

3. A sheet discharging apparatus according to claim 2, wherein said rigidity heightening means has a guide member constituting a bottom surface of said sheet conveying path, and provided with said projected member, and a pair of discharge rollers for discharging the sheet onto said discharging tray, wherein said controller restricts a movement of one roller of said pair of discharge rollers with respect to the other roller, wherein a height of a vertex of said projected member is set to a position above an upper end of one of said pair of discharge rollers when said one roller is downwardly moved and said pair of discharge rollers become spaced apart from each other, and equal to or below a nip line between said pair of discharge rollers when said pair of discharge rollers contact with each other, and in a state in which said pair of discharge rollers are spaced apart from each other, the sheet is heightened in its rigidity by said projected member, and in a state in which said pair of discharge rollers contact with each other, the rigidity of the sheet is weakened.

4. A sheet discharging apparatus according to claim 3, further comprising:

a conveying roller for conveying the sheet on said sheet conveying path, wherein said controller controls the movement of one of said pair of discharge rollers toward and away from the other so as to bring said pair of discharge rollers into a spaced-apart state when said conveying roller conveys the sheet so that a leading edge of the sheet may pass through said discharge port, and thereafter bring said pair of discharge rollers into contact with each other before a trailing edge of the sheet passes said conveying roller.

5. A sheet discharging apparatus according to claim 4, wherein said pair of discharge rollers are reversely rotatable in a direction opposite to a direction to discharge the sheet, and after said pair of discharge rollers are reversely rotated to thereby convey a preceding sheet in a direction opposite to the sheet discharging direction, said pair of discharge rollers are spaced apart from each other, and when said pair of discharge rollers are in the spaced-apart state, a succeeding sheet conveyed by said conveying roller and said preceding sheet are conveyed so as to pass by each other at said pair of discharge rollers.

6. A sheet discharging apparatus according to claim 2, further comprising a driving portion for moving said projected member, wherein said controller controls said driving portion so that said projected member is moved away from the sheet to weaken the rigidity of the sheet in the course of discharge of the sheet from said discharge port.

7. A sheet discharging apparatus according to claim 1, wherein said rigidity heightening means deforms the sheet so that the rigidity of the sheet may be heightened, and releases a deformation of the sheet in a course of discharge of the sheet.

8. A sheet treating apparatus comprising:

a sheet treating portion for effecting a predetermined treatment on a sheet; and a sheet discharging apparatus according to claim 1 for discharging the sheet treated by said sheet treating portion.

9. A sheet discharging apparatus according to claim 1, wherein a trailing edge of the sheet passes said discharge port in a state in which the rigidity of the sheet is weakened.

10. A sheet discharging apparatus comprising:

a sheet conveying path;

a discharge port provided at an end of the sheet conveying path;

a pair of discharge rollers provided at said discharge port;

a discharging tray on which a sheet discharged by said pair of discharge rollers is stacked; and a projected member provided near said discharge port, wherein one of said pair of discharge rollers is movable toward and away from the other, and wherein a height of a vertex of said projected member is set to a position above an upper end of said one pair of discharge rollers when one roller of said pair of discharge rollers is downwardly moved and said pair of discharge rollers becomes spaced apart from each other, and equal to or below a nip line between said pair of discharge rollers when said pair of discharge rollers contact each other, and in a state in which said pair of discharge rollers are spaced apart from each other, the sheet is deformed by said projected member, and in a state in which said pair of discharge rollers contact with each other, the deformation of the sheet by said projected member is released, and wherein at a beginning of discharge of the sheet from said discharge port, said pair of discharge rollers are spaced apart from each other so that the sheet is deformed by said projected member, and wherein in a course of discharge of the sheet from said discharge port, and pair of discharge rollers contact each other so that the sheet is discharged onto said discharging tray by said pair of discharge rollers, which are in a contact state.

11. A sheet treating apparatus comprising:

a sheet treating portion for effecting a predetermined treatment on a sheet; and a sheet discharging apparatus according to claim 10 for discharging the sheet treated by said sheet treating portion.

12. A sheet discharging apparatus comprising:

a sheet conveying path;

a discharge port provided at an end of the sheet conveying path;

a discharging tray on which the sheet discharged from said discharge port is stacked;

a projected member provided near said discharge port; and a moving portion for moving said projected member;

wherein said projected member deforms the sheet at a beginning of discharge of the sheet from said discharge portion, and wherein said moving portion moves said projected member away from the sheet so that the deformation of the sheet by the projected member is decreased or removed in a course of discharge of the sheet from said discharge port.

* * * * *